US010357097B1

(12) United States Patent
Goldberg

(10) Patent No.: US 10,357,097 B1
(45) Date of Patent: Jul. 23, 2019

(54) CONFIGURABLE BACKPACK

(71) Applicant: Sophie Rose Goldberg, Denver, CO (US)

(72) Inventor: Sophie Rose Goldberg, Denver, CO (US)

( * ) Notice: Subject to any disclaimer, the term of this patent is extended or adjusted under 35 U.S.C. 154(b) by 0 days.

(21) Appl. No.: 16/362,027

(22) Filed: Mar. 22, 2019

(51) Int. Cl.
*A45F 3/10* (2006.01)
*A45F 3/00* (2006.01)

(52) U.S. Cl.
CPC ..... *A45F 3/10* (2013.01); *A45F 2003/001* (2013.01)

(58) Field of Classification Search
CPC ..... A45F 3/04; A45F 3/06; A45F 3/08; A45F 3/10; A45F 2003/001
USPC ..... 224/581, 628, 645, 650, 261
See application file for complete search history.

(56) References Cited

U.S. PATENT DOCUMENTS 4,637,303 A * 1/1987 Lucky ..... A47J 47/14 126/337 R
4,852,930 A * 8/1989 Agee ..... A47F 5/0807 294/143
D387,202 S * 12/1997 Junkins ..... D3/315
6,155,470 A * 12/2000 Robison ..... F41B 5/1461 224/259
6,503,036 B1 * 1/2003 Bequette ..... B60P 3/40 410/121
6,575,313 B1 * 6/2003 Chen ..... B25H 3/02 211/70.6
6,890,138 B1 * 5/2005 Myrick ..... B60P 7/0892 410/94
7,437,796 B2 * 10/2008 Rappin ..... A01B 1/065 15/326
7,703,645 B2 * 4/2010 Moskun ..... A45F 3/08 224/579
8,690,035 B2 * 4/2014 Silverman ..... A01K 97/10 224/261
9,022,267 B2 * 5/2015 Wisselmann ..... B60R 11/0241 224/552
9,265,320 B2 * 2/2016 Bridgeforth ..... A45C 13/04
9,408,457 B2 * 8/2016 Debnam ..... A45F 5/102
10,251,467 B2 * 4/2019 Donhauser ..... A45F 3/12
2010/0230450 A1 * 9/2010 Tomberli ..... A45F 3/10 224/261
2014/0209646 A1 * 7/2014 Hoppa ..... A45F 3/08 224/261
2015/0320184 A1 * 11/2015 Bal ..... A45F 3/00 224/261

* cited by examiner

*Primary Examiner* — Justin M Larson
(74) *Attorney, Agent, or Firm* — Holland & Hart LLP

(57) ABSTRACT

A configurable backpack is described. The configurable backpack may include a rigid support element and a plurality of holes arranged on a front side of the rigid support element. The configurable backpack may also include a plurality of rods releasably coupled to the rigid support element such that the rods extend sway from the front side of the rigid support element at an acute angle with respect to the tops side when coupled to the rigid support element. The configurable backpack may also include a plurality of hook elements arranged on the front side of the rigid support element and one or more tie elements releasably coupled to one or more of the plurality of hook elements. The configurable backpack may also include a plurality of shoulder straps coupled with the back side of the rigid support element.

18 Claims, 10 Drawing Sheets

CONFIGURABLE BACKPACK

FIELD OF TECHNOLOGY

The present disclosure relates generally to apparatuses for carrying heavy and/or unwieldy loads on one's back, and more specifically to configurable backpacks.

BACKGROUND

In developing parts of the world, people carry commercial and household goods using their heads or backs. For example, millions of people still use a tumpline, which is a device that wraps around the forehead and is connected to a sack that rests on the person's back. Another method for carrying goods is by balancing large containers on the person's head. These methods suffer from several drawbacks. For example, both methods place stress on the person's head and neck and can lead to long-term bodily damage (e.g., poor posture, neck and back damage, hunched back, etc.).

DETAILED DESCRIPTION

Figure 1A:
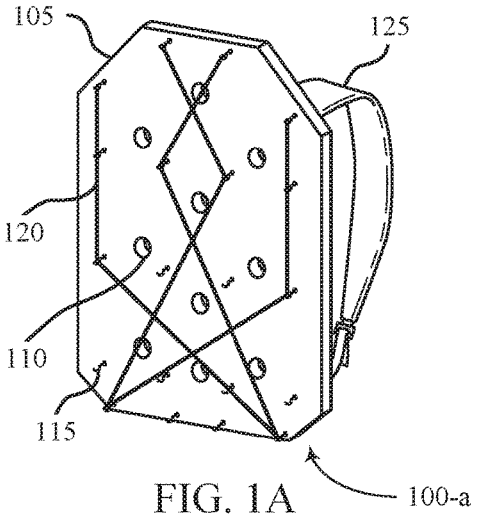
FIG. 1A illustrates a perspective view of an example of a configurable backpack with tie elements in a first configuration in accordance with aspects of the present disclosure.

In many developing countries, people must carry large loads (e.g., food, water, fire wood, building supplies) long distances on foot oftentimes on uneven, unpaved, or rough roads, paths, or trails. A common method for carrying such loads includes the use of a tumpline. However, using a tumpline can lead to bodily damage to a person's head, neck, and back because the weight is disproportionately supported by the person's neck. People using a tumpline are forced to bend over as they walk to help ease the stress on the neck, but the bending introduces additional problems for the person's back and legs.

Despite the disadvantages of the tumpline (and similar techniques such as balancing containers on a person's head), people are forced to use such rudimentary techniques because many of these people lack the financial resources to buy a backpack specifically and cost-effectively designed for carrying heavy loads. Moreover, even if a person in these circumstances could acquire an expensive backpack designed for carrying heavy loads, such backpacks are not made from materials that are readily accessible in these areas and are not easily repairable in the event of damage or inevitable degradation. In addition, typical backpacks lack the configurability for carrying a wide range of loads of commercial or household goods that differ in size, shape, and weight, such as logs, mortar, bricks, rocks, laundry, and water.

Therefore, there is a need in certain circumstances (e.g., particular developing regions of the world or particular groups of people) for an apparatus designed to carry a wide range of loads of commercial or household goods that differ in size, shape, and weight that is affordable, comfortable and safe for the user to use (e.g., in contrast to a tumpline), adjustable and configurable, durable, and repairable with readily accessible items. This need has existed for thousands of years and has not been met because existing solutions for carrying heavy loads are either too expensive, not easily repairable, lack the configurability needed for these circumstances, or a combination of these disadvantages.

In accordance with aspects of the present disclosure, a configurable backpack is described. The described backpack is lightweight, durable, configurable, and inexpensive in comparison to the existing devices described above. The described backpack generally includes a rigid portion that serves as the main back support. The rigid portion includes a pattern of holes, and the backpack includes a set of rods that are configured to attach and detach from the rigid portion via the holes. The rods may be used as support elements to hold a wide variety of loads (e.g., wood, containers of water, laundry, bricks, etc.). The pattern of holes and adjustability of the rods provides a highly configurable backpack that a wearer can modify easily throughout the day depending on the load being carried, and is adjustable to accommodate different body sizes, genders, and ages. When not in use, one or more of the rods can be attached to the rigid portion in a stowed configuration using straps, ties, a rack, or some combination of these elements.

The backpack may also include ties (e.g., bungies, cords, rope, twine) and a set of hooks attached to the rigid portion.

The hooks may be used to attach the ties (e.g., by tying or looping), which may be used to secure the load to the backpack. The hooks are also placed in a pattern across the rigid portion that provides a highly configurable attachment surface. For example, the hooks may be used to route the ties in a wide variety of patterns that are capable of holding large loads (e.g., a pile of bricks) to small bundles of twigs.

As described in more detail below, the components of the described backpack may be made from cheap and/or readily accessible materials. For example, the rods may be made from plastic rods or wooden dowels. As such, if a rod were to break, an owner of the backpack could replace or even make a replacement relatively easily with available materials. In addition, the ties can be made from any suitable material and can be easily replaced or substituted as needed. The main rigid portion of the backpack can be made from relatively inexpensive yet durable materials (e.g., plastic or wood).

Therefore, the configurable backpack described herein provides for a way to carry a wide variety of large loads in situations where a particular combination of cost efficiency, durability, reparability, and configurability is needed.

FIG. 1A illustrates a perspective view of an example of a configurable backpack 100-*a* in accordance with aspects of the present disclosure. The configurable backpack 100-*a* may include a rigid support element 105, a plurality of holes 110 arranged on the front side of the rigid support element 105, a plurality of hook elements 115 arranged on the front side of the rigid support element 105, one or more tie elements 120 releasably coupled to one or more of the plurality of hook elements 115, and a plurality of shoulder straps 125 coupled with the back side of the rigid support element 105.

The rigid support element 105 may be made from a polymeric material, wood, aluminum, or any other suitable rigid material. In an example, the rigid support element 105 is made from polyethylene plastic. The front side of the rigid support element 105 may be planar, and the back side of the rigid support element 105 may also be planar. In some examples, the back side of the rigid support element 105 may be contoured or may include a curved element to generally conform to the curvature of a human back or neck. As shown in FIG. 1A, the top side of the rigid support element 105 may include angled cuts that remove some material from the rigid support element 105 which may further reduce the weight of the rigid support element 105 and provide space for the wearer to move their head from side to side. The size of the rigid support element 105 can vary and may depend on the size of the wearer (e.g., there may be large, medium, and small sizes). In one example, the rigid support element 105 has a height of 40 inches, a width of 24 inches and a thickness of 4 inches.

The plurality of holes 110 may extend at least partially through the rigid support element 105 from the front side to the back side of the rigid support element 105. In some examples, one or more of the plurality of holes 110 extend through an entire thickness of the rigid support element 105. As described in more detail below, if the holes 110 extend through an entire thickness of the rigid support element 105, if a rod were to break off inside one of the holes 110, then a person could more easily remove the broken portion of the rod by pushing it out through the hole 110 from either the front or back side of the rigid support element 105.

The plurality of holes 110 may be bored or otherwise machined into the rigid support element 105 at an acute angle with respect to the top side of the rigid support element 105. As such, when rods are inserted into the plurality of holes 110, the rods will be oriented at an acute angle with respect to the tops side of the rigid support element 105. The plurality of holes 110 may be arranged on the front side of the rigid support element 105 in a variety of patterns in addition to the pattern illustrated in FIG. 1A. As described in more detail below, the hole pattern may facilitate a highly customizable surface for attaching rods in a variety of configurations to carry a range of items and weights and to balance the load of an object attached to the configurable backpack 100-*a*.

The plurality of hook elements 115 may be arranged on the front side of the rigid support element 105 in a pattern illustrated in FIG. 1A or in any other suitable pattern. The hook elements 115 may generally act as attachment points and/or routing points for the tie elements 120. The hook elements 115 may be eyelet hooks, shepherd hooks, pegs, or any other type of hook suitable for attaching or routing a tie element 120, and multiple types of hook elements 115 may be coupled to the rigid support element 105 at once. The hook elements 115 may be attached to the rigid support element 105 in a variety of ways such as by screwing, press fit, gluing, snapping, or any other similar attachment technique. In some examples, the hook elements 115 are permanently attached to the rigid support element 105. In alternative examples, the one or more of the hook elements 115 may be releasably coupled to the rigid support element 105 in a similar manner as the rods (as described below) or by using some other releasable mechanism such as threading, a cotter pin, or the like.

The tie elements 120 may be releasably coupled to one or more of the plurality of hook elements 115 by way of tying, hooking, or any other similar attachment technique. The tie elements 120 may be any time of cord, rope, string, or bungie that is suitable for attaching to the hook elements 115 and securing one or more objects to the rigid support element 105. The tie elements 115 may be elastic or non-elastic. In some examples, the tie elements 120 may be bungie cords and may include hooks at either end which releasably coupled to the hook elements 115. As discussed in more detail below, the tie elements 120 may be routed along different paths across the rigid support element 105, using the hook elements 115 as routing points, to customize the configuration for a particular object or load being carried by the configurable backpack 110-*a*. For example, in one configuration, one or more tie elements 120 are coupled to an eyelet hook at each end of the one or more tie elements 120 and the one or more tie elements are routed through one or more shepherd hooks between the two ends.

In an example configuration illustrated in FIG. 1A, the plurality of holes 110 are arranged into three horizontal rows of holes 110, with the top and middle rows each including two holes 110, and the bottom row including three holes 110. As such, at least two rows of the plurality of holes 110 contain a different number of holes 110. There is also a hole 110 between the bottom and middle row, a hole 110 between the middle and top row, and a hole 110 above the top row. These three additional holes are arranged along a central axis of the configurable backpack 100-*a*. The hook elements 115 include four eyelet hooks arranged in a row near the bottom end of the rigid support element 105, two eyelet hooks arranged in a row near the top of the rigid support element 105, and one eyelet hook near each angled cut towards the top of the rigid support element 105. The hook elements 115 also include three rows of four shepherd hooks, with a first row below the top row of holes 110, a second row below the middle row of holes 110, and a third row below the bottom row of holes 110.

In another example configuration, the plurality of holes 110 are arranged into a plurality of rows that are parallel with the top side of the rigid support element 105. Each row of holes 110 may include two holes 110. The hook elements 115 include a set of shepherd hooks that are arranged into a plurality of rows that are parallel with the top side of the rigid support element 105. In this example configuration, the number of rows of the holes 110 is equal to the number of rows of shepherd hooks, and each row of shepherd hooks is located below a corresponding row of holes 110. Furthermore, in this example configuration, the hook elements 115 include a set of eyelet hooks that are arranged at least partially around a perimeter of the rigid support element 105 (e.g., near the top and bottom sides of the rigid support element 105).

The shoulder straps 125 may be coupled to the backside of the rigid support element 125 using a variety of attachment techniques. The shoulder straps 125 may generally be padded straps that adjust similarly to that of a standard backpack shoulder strap. As described in more detail below, the rigid support element 105 may include slits and/or other attachment points for the shoulder straps 125 to attach.

Figure 1B:
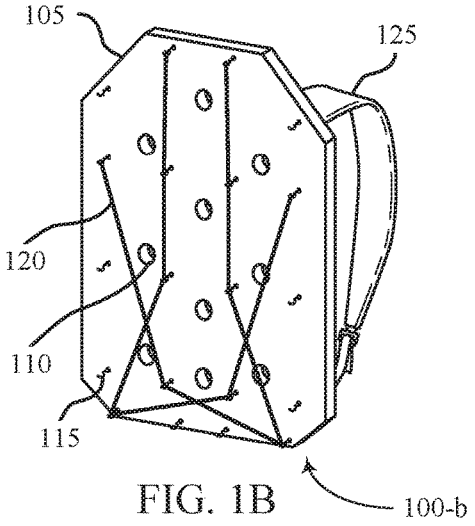
FIG. 1B illustrates a perspective view of an example of a configurable backpack with tie elements in a second configuration in accordance with aspects of the present disclosure.

FIG. 1B illustrates a perspective view of an example of a configurable backpack 100-*b* in accordance with aspects of the present disclosure. The configurable backpack 100-*b* shows the tie elements 120 routed in a different configuration than that shown in FIG. 1A to illustrate the configurability of the configurable backpack 110-*b*.

Figure 1C:
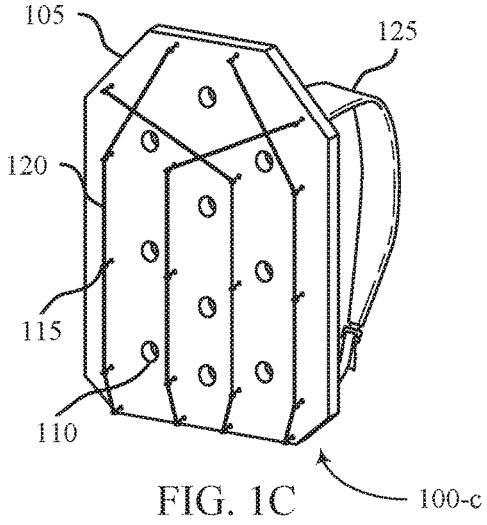
FIG. 1C illustrates a perspective view of an example of a configurable backpack with tie elements in a third configuration in accordance with aspects of the present disclosure.

FIG. 1C illustrates a perspective view of an example of a configurable backpack 100-*c* in accordance with aspects of the present disclosure. The configurable backpack 100-*c* shows the tie elements 120 routed in a different configuration than that shown in either of FIG. 1A or FIG. 1B to illustrate the configurability of the configurable backpack 110-*c*.

Figure 1D:
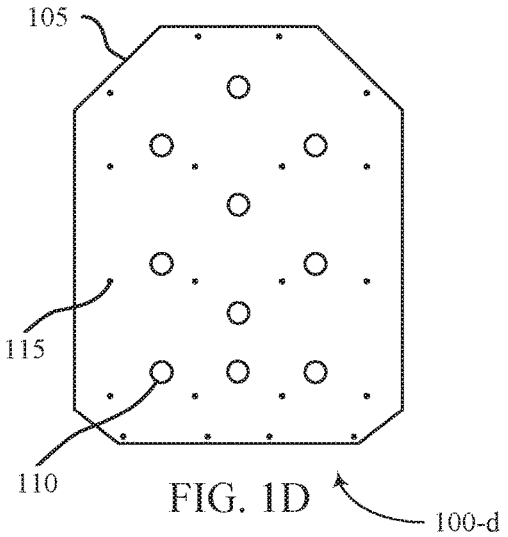
FIG. 1D illustrates a plan view of an example of a configurable backpack without tie elements in accordance with aspects of the present disclosure.

FIG. 1D illustrates a plan view of the front side of an example of a configurable backpack 100-*d* in accordance with aspects of the present disclosure. The pattern of holes 110 and hook elements 115 is just an example of one possible arrangement, but other patterns are possible and within the scope of the present disclosure.

Figure 2A:
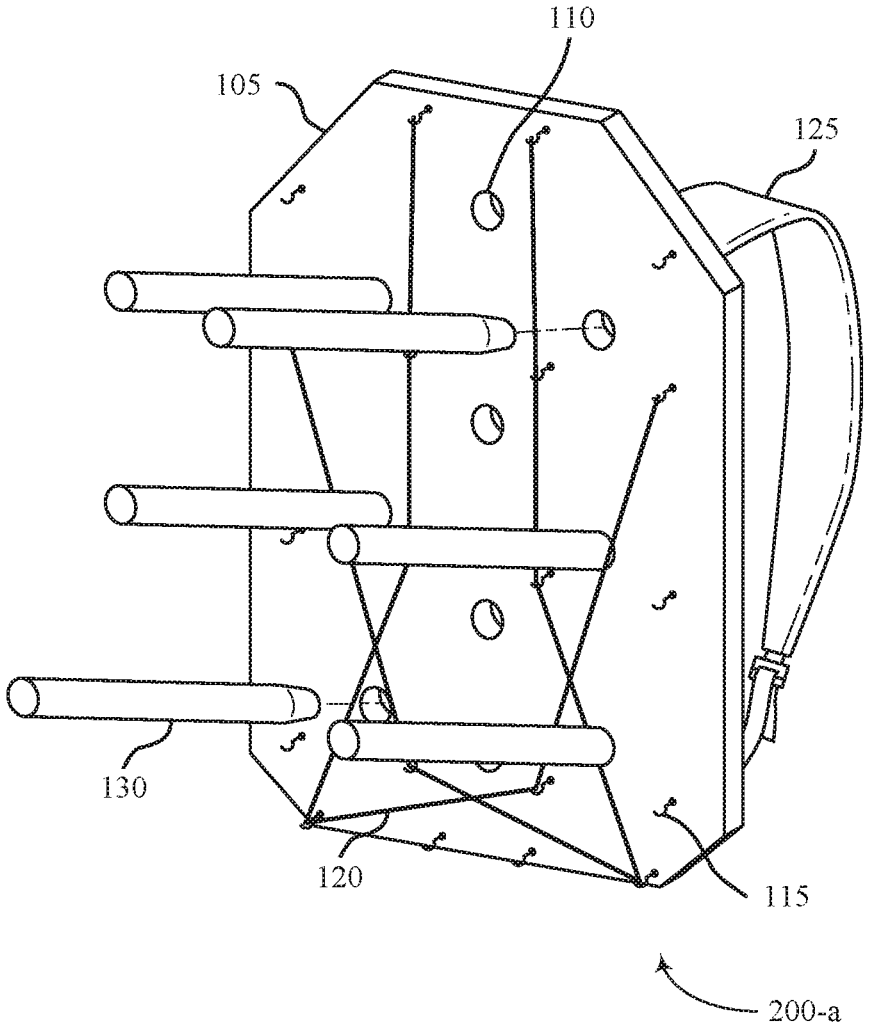
FIG. 2A illustrates a perspective view of an example of a configurable backpack with one or more rods in an exploded view in accordance with aspects of the present disclosure.

FIG. 2A illustrates a perspective view of an example of a configurable backpack 200-*a* in accordance with aspects of the present disclosure. The configurable backpack 200-*a* may include a rigid support element 105, a plurality of holes 110 arranged on the front side of the rigid support element 105, a plurality of hook elements 115 arranged on the front side of the rigid support element 105, one or more tie elements 120 releasably coupled to one or more of the plurality of hook elements 115, a plurality of shoulder straps 125 coupled with the back side of the rigid support element 105, and a plurality of rods 130 releasably coupled to the rigid support element 105. As shown in the example configurable backpack 200-*a*, the plurality of rods 130 extend away from the front side of the rigid support element 105 at an acute angle with respect to the top side of the rigid support element 105 when coupled to the rigid support element 105. In some examples, the acute angle is approximately 80 degrees.

The plurality of rods 130 may be sized and configured to be inserted into any of the plurality of holes 130. The rods 130 may be made from a variety of rigid materials including a polymeric material, wood, or aluminum. The rods 130 may be configured to releasably attach to the rigid support element 105 using a variety of attachment techniques. For example, the rods 130 may be configured to press fit into the plurality of holes 110. As such, when a rod 130 is inserted into a hole 110 with sufficient force, the interference fit between the outer diameter of the rod 105 and the inner diameter of the hole 110 creates a frictional force that holds the rod 130 in place. Furthermore, because the rods 130 are angled with respect to the rigid support element 105, a downward force on the rods 130 cantilevers the rods within the holes 110 and creates additional friction force that prevents inadvertent removal of the rods 130 as they carry a load. However, the outer diameter of the rod 130 may be sized such that the interference fit is such that the rods 130 are removable. The ability to securely attach the rods 130 to the rigid support element 105 yet be able to remove them and reinsert them into different holes 110 facilitates the configurability of the configurable backpack 200-*a*. In some examples, the ends of the rods 130 may be shaped to facilitate the press fitting into the holes 110. For example, the ends of the rods 130 may be tapered. Although a press-fit design is described, the rods 130 may be attached to the rigid support element 105 using a variety of other attachment techniques such as threading, snapping into place, cotter pin, etc.

As described above, the holes 110 may extend through an entire thickness of the rigid support element 105. However, the rods 130 may extend only partially into a thickness of the rigid support element 105 such that the rods 130 do not protrude from the back side of the rigid support element 105 (and into the back of the user). The taper on the end of the rods 130 may be shaped and sized to facilitate a proper press fit without allowing the rod 130 to protrude all the way through the rigid support element 105.

Figure 2B:
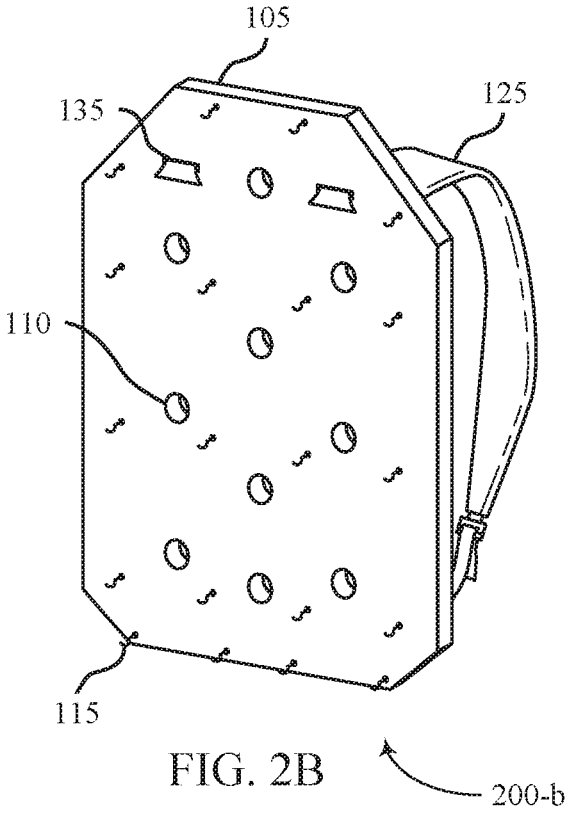
FIG. 2B illustrates a front perspective view of an example of a configurable backpack in accordance with aspects of the present disclosure.

FIG. 2B illustrates a perspective view of an example of a configurable backpack 200-*b* in accordance with aspects of the present disclosure. The configurable backpack 200-*b* may include a rigid support element 105, a plurality of holes 110 arranged on the front side of the rigid support element 105, a plurality of hook elements 115 arranged on the front side of the rigid support element 105, and a plurality of shoulder straps 125 coupled with the back side of the rigid support element 105. As shown in FIG. 2B, the shoulder straps 125 may be attached to the rigid support element 105 via two slits 135 cut into the rigid support element 105. In this example, one end of each shoulder strap 125 extends through a slit 135 from the back side of the rigid support element 105 to the front side of the rigid support element 105 and unfolds or otherwise deploys in a manner that prevents the shoulder strap 125 from falling back through the slit 135. In some examples, the ends of the shoulder strap 125 may include a flap that extends generally perpendicular to the remaining portion of the strap 125 such that the flap portion rests against the front side of the rigid support element 105. In other examples, the end of the strap 125 that extends through the slit 135 may include some other element that allows it to pass through the slit 135 in one direction, but prevents it from falling back through in the other direction.

Figure 2C:
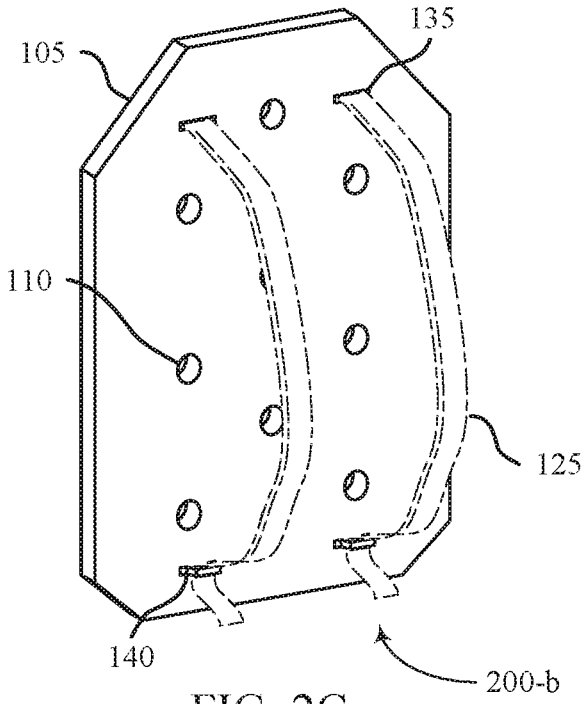
FIG. 2C illustrates a perspective view of the back side of an example of a configurable backpack in accordance with aspects of the present disclosure.

FIG. 2C illustrates a perspective view of the back side of the configurable backpack 200-*b* in accordance with aspects of the present disclosure. The configurable backpack 200-*b* may include a set of strap attachment elements 140 that attaches one end of the shoulder strap 125 to the back side of the rigid support element 105. The strap attachment element 140 may be a hook, bracket, or any other similar element that extends from the back side of the rigid support element 105 to create a loop through which an end of the shoulder strap 125 may be looped and tied or otherwise secured. Although the configurable backpack 200-*b* shows only two slits 135 towards the top of the rigid support element 105 and two strap attachment elements 140 towards the bottom of the rigid support element 105, it should be understood that these two mechanisms for attaching the shoulder strap 125 to the rigid support element 105 can be used in any combination. For example, the configurable backpack 200-*b* could instead have four slits 135 for attaching both shoulder straps 125, or instead could have four strap attachment elements 140 for attaching both shoulder straps 125, or could have the slits 135 at the bottom and the strap attachment elements 140 at the top, or any combination of these arrangements.

Figure 3A:
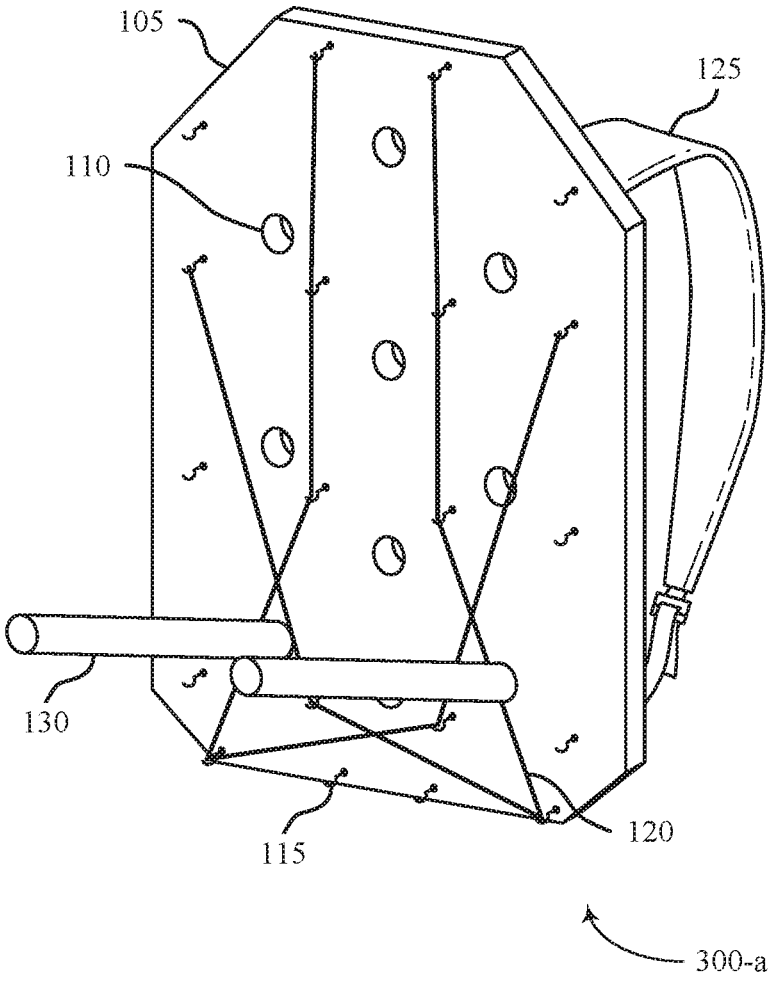
FIG. 3A illustrates a perspective view of an example of a configurable backpack with tie elements and rods in a first configuration in accordance with aspects of the present disclosure.

FIG. 3A illustrates a perspective view of an example of a configurable backpack 300-*a* in accordance with aspects of the present disclosure. The configurable backpack 300-*a* may include a rigid support element 105, a plurality of holes 110 arranged on the front side of the rigid support element 105, a plurality of hook elements 115 arranged on the front side of the rigid support element 105, one or more tie elements 120 releasably coupled to one or more of the plurality of hook elements 115, a plurality of shoulder straps 125 coupled with the back side of the rigid support element 105, and a plurality of rods 130 releasably coupled to the rigid support element 105. As shown in the example configurable backpack 300-*a*, the plurality of rods 130 extend away from the front side of the rigid support element 105 at an acute angle with respect to the top side of the rigid support element 105 when coupled to the rigid support element 105.

As shown in the example of FIG. 3A, the rods 130 are shown in a configuration where only two rods 130 are used, and where the rods 130 are placed near the bottom of the rigid support element 105. As described with reference to the subsequent figures, such a configuration may be used for carrying larger loads, where a majority of the surface area of the rigid support element 105 is needed fit the objects being carried. As such, being able to move the rods 130 to the bottom of the rigid support element 105 and remove the other rods 130 (and store the rods 130 as described with reference to FIGS. 5A and 5B) thereby providing open space on the rigid support element 105 demonstrates an advantage of the configurability of the configurable backpack 300-*a*.

Figure 3B:
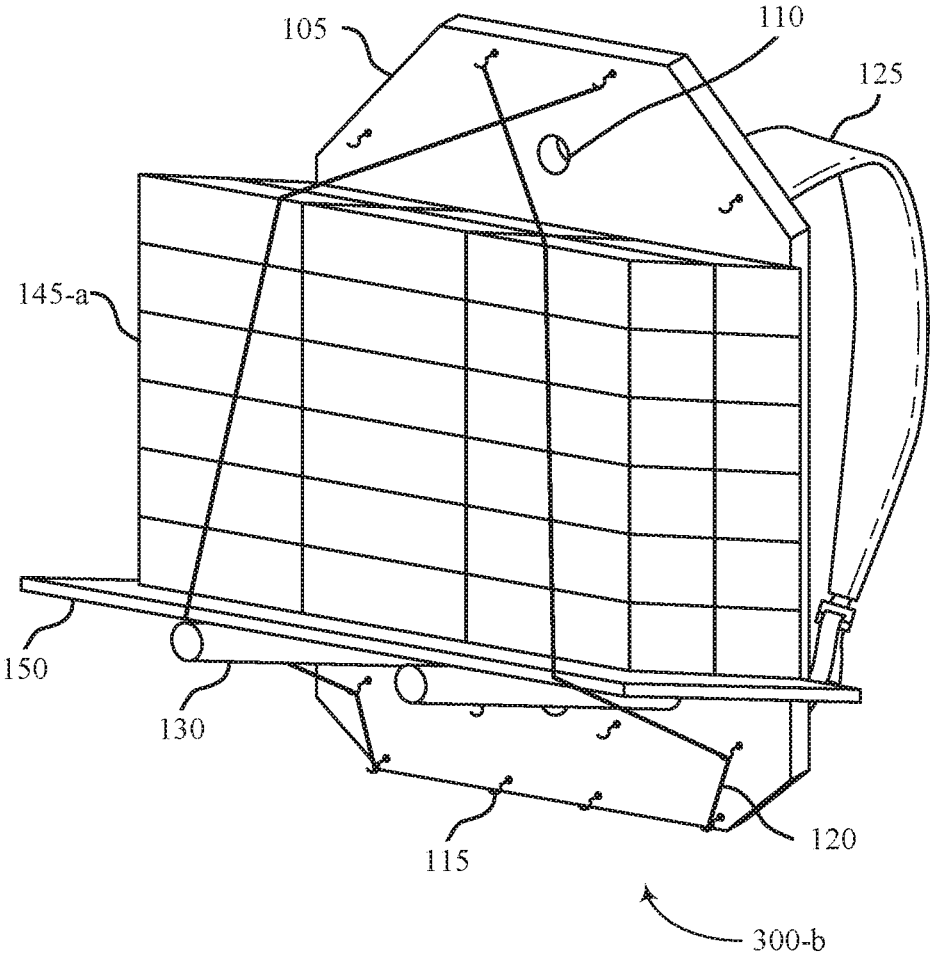
FIG. 3B illustrates a perspective view of an example of a configurable backpack with tie elements and rods in a second configuration with a load in accordance with aspects of the present disclosure.

FIG. 3B illustrates a perspective view of an example of a configurable backpack 300-*b* in accordance with aspects of the present disclosure. The configurable backpack 300-*b* may include a rigid support element 105, a plurality of holes 110 arranged on the front side of the rigid support element 105, a plurality of hook elements 115 arranged on the front side of the rigid support element 105, one or more tie elements 120 releasably coupled to one or more of the plurality of hook elements 115, a plurality of shoulder straps 125 coupled with the back side of the rigid support element 105, and a plurality of rods 130 releasably coupled to the rigid support element 105. The rods 130 are shown in a configuration described with respect to FIG. 3A.

The configurable backpack 300-*b* is shown carrying an object 145-*a*. The object 145-*a* may be a stack of bricks or some other similar load of objects that is relatively heavy and large compared to the available carrying size of the configurable backpack 300-*b*. The object 145-*a* may be supported by a board 150, which is in turn supported by the rods 130. As shown, the tie element 120 can be routed across the object 145-*a* (using the many available hook elements 115) in a way that securely holds the object 145-*a* in place against the rigid support element 105.

Figure 3C:
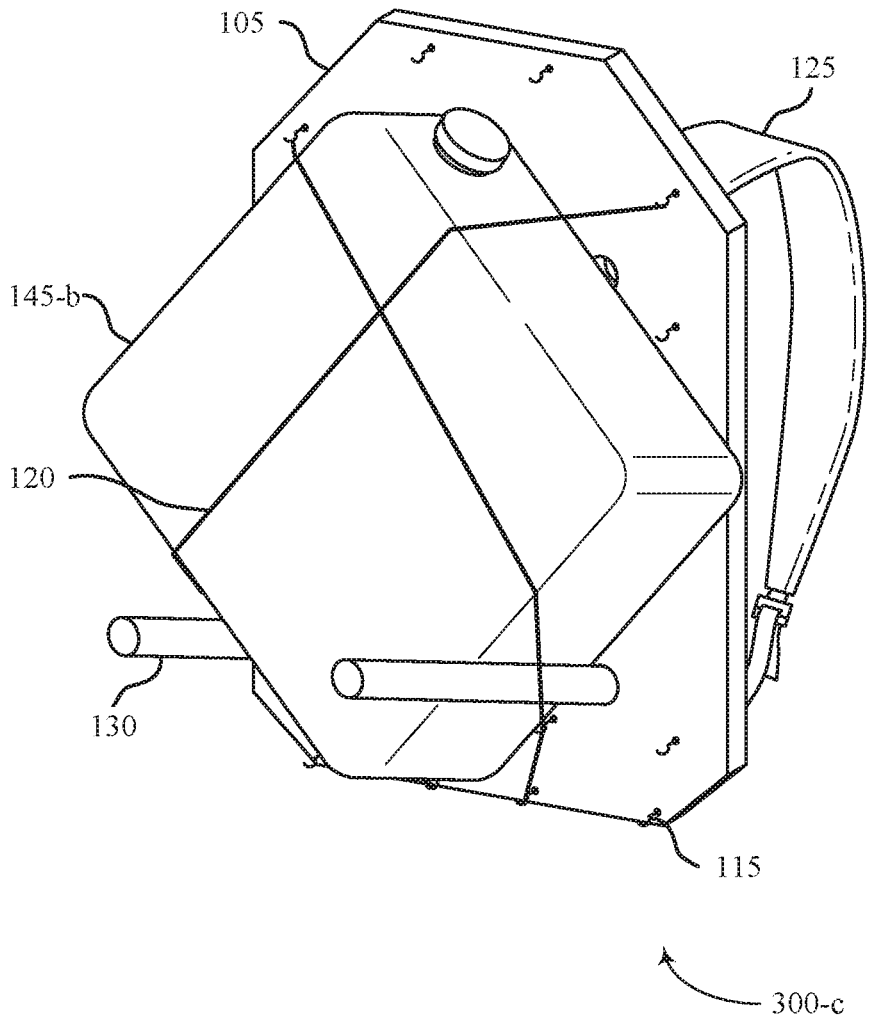
FIG. 3C illustrates a perspective view of an example of a configurable backpack with tie elements and rods in a third configuration with a load in accordance with aspects of the present disclosure.

FIG. 3C illustrates a perspective view of an example of a configurable backpack 300-*c* in accordance with aspects of the present disclosure. The configurable backpack 300-*c* may include a rigid support element 105, a plurality of holes 110 arranged on the front side of the rigid support element 105, a plurality of hook elements 115 arranged on the front side of the rigid support element 105, one or more tie elements 120 releasably coupled to one or more of the plurality of hook elements 115, a plurality of shoulder straps 125 coupled with the back side of the rigid support element 105, and a plurality of rods 130 releasably coupled to the rigid support element 105. The rods 130 are shown in a configuration described with respect to FIG. 3A.

The configurable backpack 300-*c* is shown carrying an object 145-*b*. The object 145-*b* may be a large container for water or other liquid or some other similar object that is relatively heavy and large compared to the available carrying size of the configurable backpack 300-*c*. As shown, the object 145-*b* may be tilted and wedged between the two rods 130. As shown, the tie element 120 can be routed across the object 145-*b* (using the many available hook elements 115) in a way that securely holds the object 145-*b* in place against the rigid support element 105.

Figure 4A:
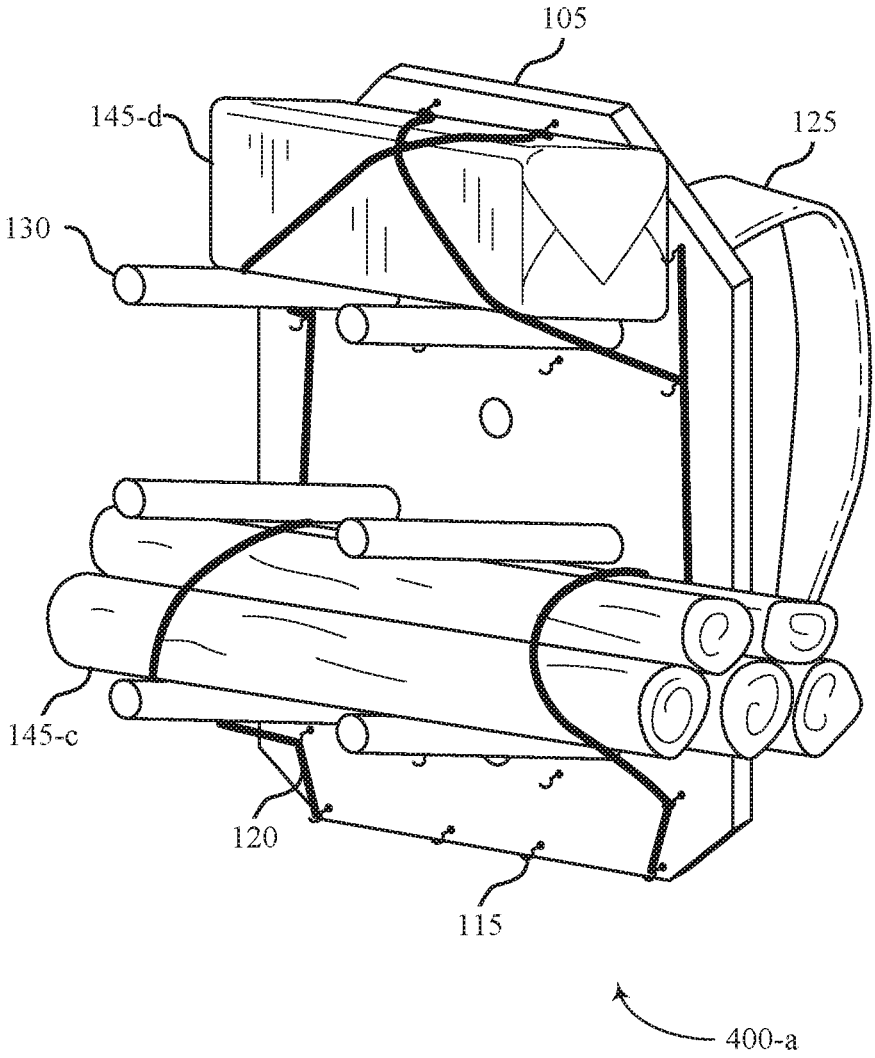
FIG. 4A illustrates a perspective view of an example of a configurable backpack with tie elements and rods in a first configuration with a load in accordance with aspects of the present disclosure.

FIG. 4A illustrates a perspective view of an example of a configurable backpack 400-*a* in accordance with aspects of the present disclosure. The configurable backpack 400-*a* may include a rigid support element 105, a plurality of holes 110 arranged on the front side of the rigid support element 105, a plurality of hook elements 115 arranged on the front side of the rigid support element 105, one or more tie elements 120 releasably coupled to one or more of the plurality of hook elements 115, a plurality of shoulder straps 125 coupled with the back side of the rigid support element 105, and a plurality of rods 130 releasably coupled to the rigid support element 105. As shown in the example configurable backpack 400-*a*, the plurality of rods 130 extend away from the front side of the rigid support element 105 at an acute angle with respect to the top side of the rigid support element 105 when coupled to the rigid support element 105.

As shown in the example of FIG. 4A, the rods 130 are shown in a configuration where six rods 130 are used, and where the rods 130 are arranged into three rows. Such a configuration may support the carrying of multiple smaller loads as compared to the configuration illustration with reference to FIG. 3A. For example, the configurable backpack 400-*a* may carry an object 145-*c* in between two rows of rods 130. Object 145-*c* may include a bundle of wood or similarly shaped objects. The tie elements 120 may be routed across the object 145-*c* to securely hold the bundle of wood together and to the rigid support element 105. In a similar manner, the configurable backpack 400-*a* may carry an object 145-*d* that is supported by the top row of rods 130. This object 145-*d* may be a package or some similar shaped item and may be securely attached to the rigid support element 105 by the tie elements 120.

Figure 4B:
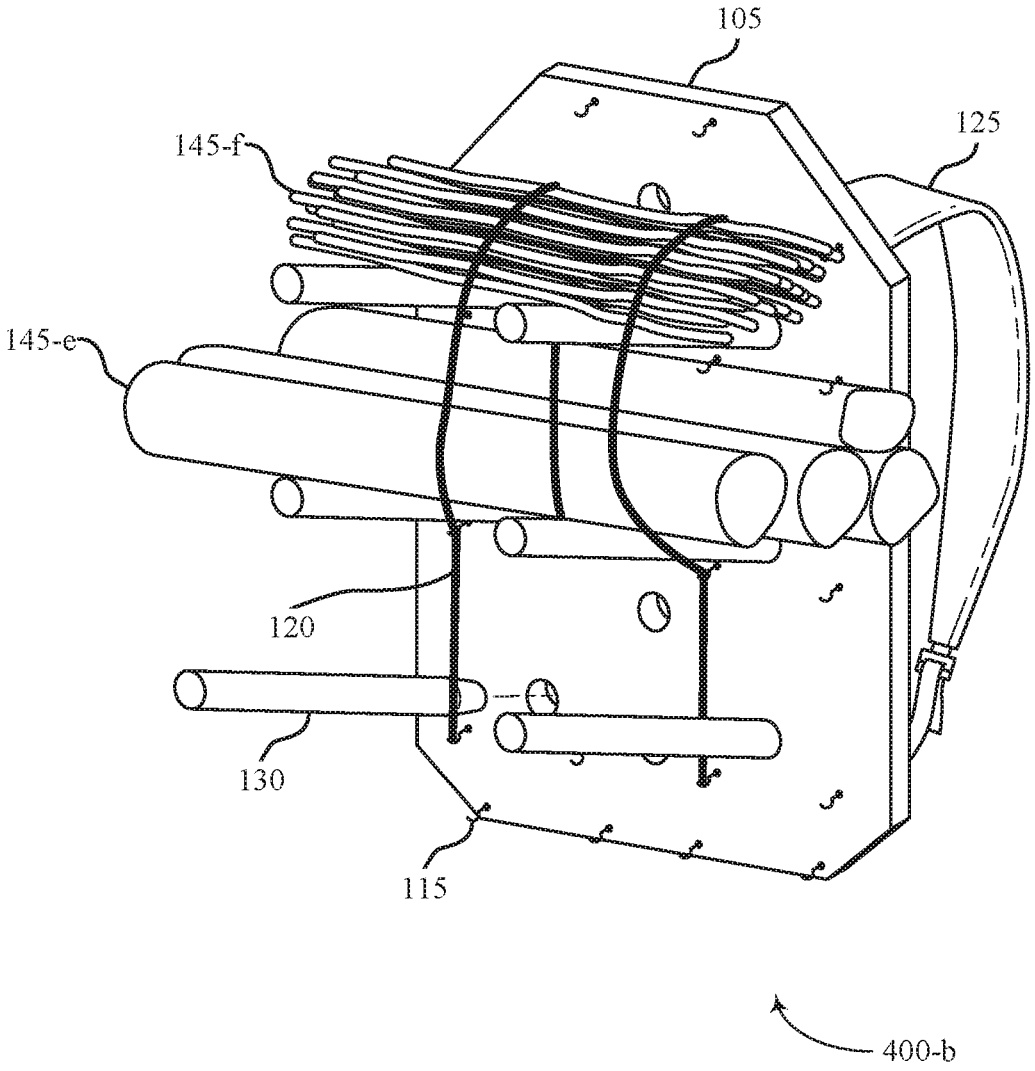
FIG. 4B illustrates a perspective view of an example of a configurable backpack with tie elements and rods in a second configuration with a load in accordance with aspects of the present disclosure.

FIG. 4B illustrates a perspective view of an example of a configurable backpack 400-*b* in accordance with aspects of the present disclosure. The configurable backpack 400-*b* may include a rigid support element 105, a plurality of holes 110 arranged on the front side of the rigid support element 105, a plurality of hook elements 115 arranged on the front side of the rigid support element 105, one or more tie elements 120 releasably coupled to one or more of the plurality of hook elements 115, a plurality of shoulder straps 125 coupled with the back side of the rigid support element 105, and a plurality of rods 130 releasably coupled to the rigid support element 105. As shown in the example configurable backpack 400-*b*, the plurality of rods 130 extend away from the front side of the rigid support element 105 at an acute angle with respect to the top side of the rigid support element 105 when coupled to the rigid support element 105.

The rods 130 are shown in a configuration similar to that shown in FIG. 4A. Such a configuration may support the carrying of multiple smaller loads as compared to the configuration illustration with reference to FIG. 3A. For example, the configurable backpack 400-*b* may carry an object 145-*e* in between the top and middle rows of rods 130. Object 145-*e* may include a bundle of wood or similarly shaped objects. The tie elements 120 may be routed across the object 145-*e* to securely hold the bundle of wood together and to the rigid support element 105. In a similar manner, the configurable backpack 400-*b* may carry an object 145-*f* that is supported by the top row of rods 130. This object 145-*f* may be a smaller bundle of sticks or some similar shaped item and may be securely attached to the rigid support element 105 by the tie elements 120.

Figure 5A:
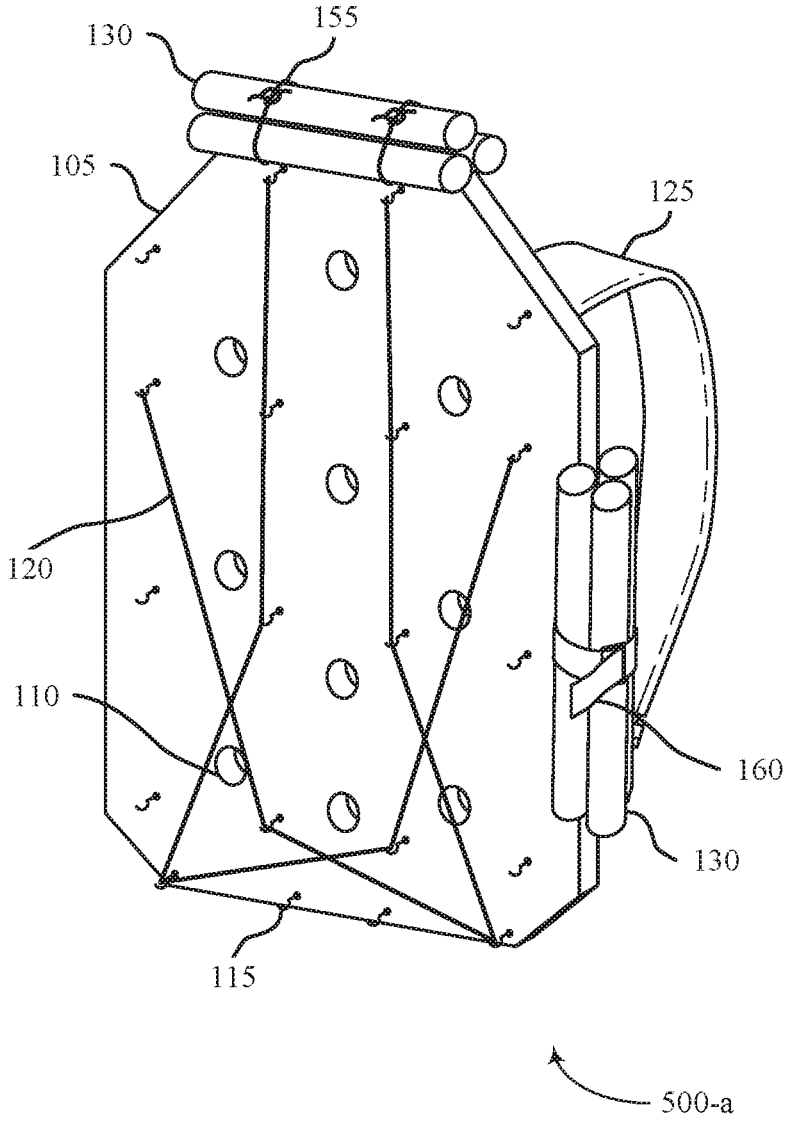
FIG. 5A illustrates a perspective view of an example of a configurable backpack with the rods in a stowed configuration in accordance with aspects of the present disclosure.

FIG. 5A illustrates a perspective view of an example of a configurable backpack 500-*a* in accordance with aspects of the present disclosure. The configurable backpack 500-*a* may include a rigid support element 105, a plurality of holes 110 arranged on the front side of the rigid support element 105, a plurality of hook elements 115 arranged on the front side of the rigid support element 105, one or more tie elements 120 releasably coupled to one or more of the plurality of hook elements 115, a plurality of shoulder straps 125 coupled with the back side of the rigid support element 105, and a plurality of rods 130 in a stowed configuration on the rigid support element 105.

As shown, the configurable backpack 500-*a* may include storage elements to stow one or more rods 130 when not in use. For example, if a user transitions the configurable backpack 5(X)-a from a configuration that uses six rods (e.g., as shown with reference to FIG. 4A) to a configuration that uses two rods (e.g., as shown with reference to FIG. 3A), then the user may store the extra rods in a convenient manner by using ties 155 and/or a strap and buckle system 160. The ties 155 may be string, cord, or elastic material that can be used to secure a stack of one or more rods 130 to the rigid support element 105 when not in use. Similarly, the strap and buckle system 160 may be used in addition to or as an alternative to the ties 155. The ties 155 and the strap and buckle system 160 can be placed in alternative locations than those illustrated in FIG. 5A (e.g., on the bottom of the rigid support element 105), and are generally configured to store one or more of the rods 130 when not in use.

Figure 5B:
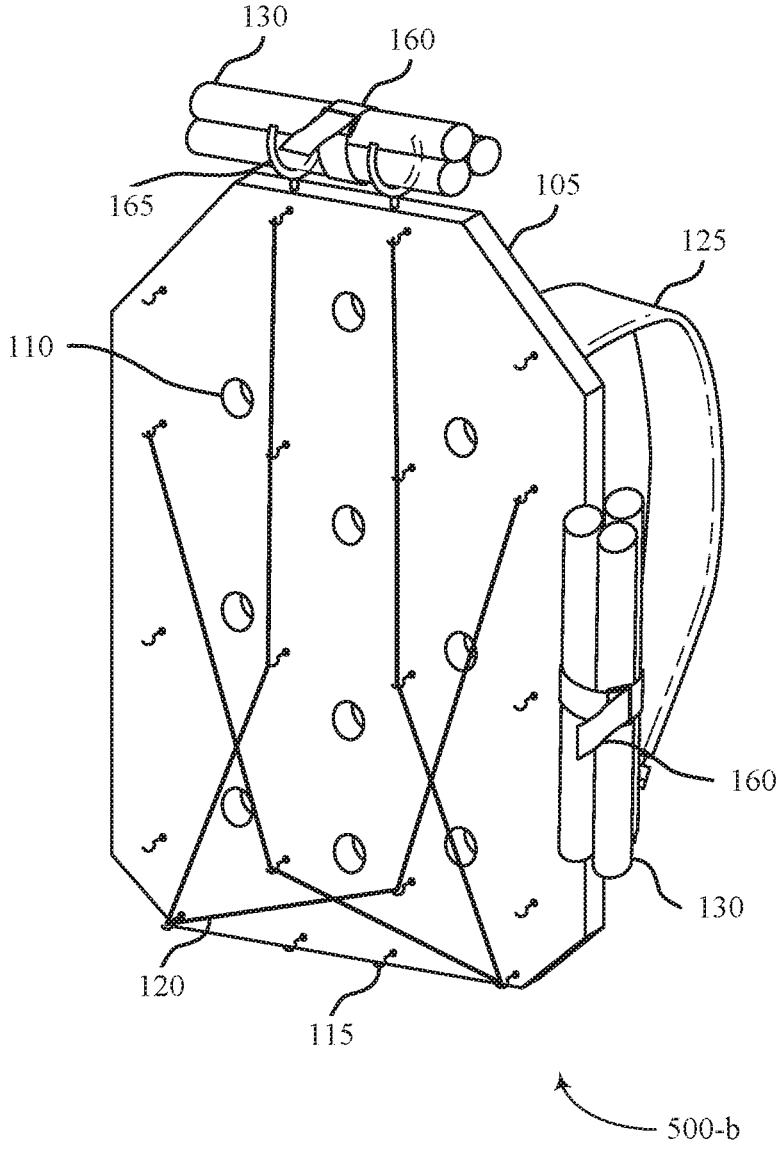
FIG. 5B illustrates a perspective view of an example of a configurable backpack with the rods in a stowed configuration in accordance with aspects of the present disclosure.

FIG. 5B illustrates a perspective view of an example of a configurable backpack 500-*b* in accordance with aspects of the present disclosure. The configurable backpack 500-*b* may include a rigid support element 105, a plurality of holes 110 arranged on the front side of the rigid support element 105, a plurality of hook elements 115 arranged on the front side of the rigid support element 105, one or more tie elements 120 releasably coupled to one or more of the plurality of hook elements 115, a plurality of shoulder straps 125 coupled with the back side of the rigid support element 105, and a plurality of rods 130 in a stowed configuration on the rigid support element 105.

As shown, the configurable backpack 500-*b* may include storage elements to stow one or more rods 130 when not in use. For example, the configurable backpack 500-*b* may include clips 165 (or a rack) which may generally support and/or grasp the stowed rods 130. The clips 165 may be used in conjunction with the strap and buckle system 160 and/or the ties 155 illustrated in FIG. 5A, or the clips 165 may be used by themselves.

It may be appreciated that patterns of the location of the holes 110, hook elements 115, tie elements 120, and/or rods 130 other than those described herein may be configured to carry a variety of loads with a configurable backpack without departing from the scope of the present disclosure.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block or simplified form in order to avoid obscuring the concepts of the described examples.

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

What is claimed is:

1. A backpack, comprising:

a rigid support element having a front side, a back side opposite the front side, a top side, and a bottom side opposite the top side;

a plurality of holes arranged on the front side of the rigid support element and extending at least partially through the support element from the front side towards the back side;

a plurality of rods releasably coupled to the rigid support element, wherein the plurality of rods extend away from the front side and at an acute angle with respect to the top side when coupled to the rigid support element;

a plurality of hook elements arranged on the front side of the rigid support element;

one or more tie elements releasably coupled to one or more of the plurality of hook elements; and a plurality of shoulder straps coupled with the back side of the rigid support element.

2. The backpack of claim 1, wherein the front side of the rigid support element is planar.

3. The backpack of claim 2, wherein the back side of the rigid support element is planar.

4. The backpack of claim 1, wherein the rigid support element comprises a polymeric material.

5. The backpack of claim 1, wherein the plurality of holes extend through an entire thickness of the rigid support element.

6. The backpack of claim 1, wherein the plurality of holes are bored into the rigid support element at the acute angle with respect to the top side of the rigid support element.

7. The backpack of claim 1, wherein the plurality of rods are configured to press fit into the plurality of holes.

8. The backpack of claim 7, wherein the plurality of rods comprise a tapered end that press fits into the plurality of holes.

9. The backpack of claim 1, wherein the plurality of rods are configured to extend only partially through an entire thickness of the rigid support element.

10. The backpack of claim 1, wherein the plurality of rods comprise a polymeric material or a wood material.

11. The backpack of claim 1, wherein the plurality of hook elements comprises a set of eyelet hooks and a set of shepherd hooks.

12. The backpack of claim 11, wherein the one or more tie elements are coupled to an eyelet hook of the set of eyelet hooks at each end of the one or more tie elements, and wherein the one or more tie elements are routed through one or more of the set of shepherd hooks.

13. The backpack of claim 11, wherein:

the plurality of holes are arranged into a plurality of rows that are parallel with the top side of the rigid support element;

the set of shepherd hooks are arranged into a plurality of rows that are parallel with the top side of the rigid support element;

a number of the plurality of rows of the holes is equal to a number of the plurality of rows of the set of shepherd hooks; and each row of the plurality of rows of the set of shepherd hooks is located below a corresponding row of the plurality of rows of the holes.

14. The backpack of claim 13, wherein the set of eyelet hooks is arranged around a perimeter of the rigid support element.

15. The backpack of claim 13, wherein at least two rows of the plurality of rows of the plurality of holes contain a different number of holes.

16. The backpack of claim 1, wherein the one or more tie elements comprise bungie cords.

17. The backpack of claim 1, further comprising:

one or more storage elements coupled to the rigid support element configured to store the plurality of rods when decoupled from the rigid support element.

18. The backpack of claim 17, where the one or more storage elements comprise one or more straps or one or more buckles coupled with the rigid support element.

* * * * *